US007209087B2

(12) United States Patent
Tang et al.

(10) Patent No.: US 7,209,087 B2
(45) Date of Patent: Apr. 24, 2007

(54) MOBILE PHONE ANTENNA

(75) Inventors: Chia-Lun Tang, Miao-Li Hsien (TW); Kin-Lu Wong, Kao-Hsiung (TW); Saou-Wen Su, Taipei (TW)

(73) Assignees: Industrial Technology Research Institute, Hsinchu (TW); National Sun Yat-Sen University, Kaohsiung (TW)

( * ) Notice: Subject to any disclaimer, the term of this patent is extended or adjusted under 35 U.S.C. 154(b) by 59 days.

(21) Appl. No.: 11/258,762

(22) Filed: Oct. 26, 2005

(65) Prior Publication Data

US 2007/0063901 A1 Mar. 22, 2007

(30) Foreign Application Priority Data

Sep. 22, 2005 (TW) ..... 94132804 A

(51) Int. Cl.
*H01Q 1/24* (2006.01)

(52) U.S. Cl. ..... 343/702; 343/700 MS

(58) Field of Classification Search ..... 343/702, 343/700 MS, 846, 848
See application file for complete search history.

(56) References Cited

U.S. PATENT DOCUMENTS

| | | | | |
|---|---|---|---|---|
| 6,717,548 | B2 | 4/2004 | Chen | 343/700 |
| 6,952,187 | B2 * | 10/2005 | Annamaa et al. | 343/702 |
| 2002/0140612 | A1 * | 10/2002 | Kadambi et al. | 343/702 |
| 2004/0119656 | A1 * | 6/2004 | Apostolos | 343/895 |
| 2004/0185897 | A1 | 9/2004 | Ostervall | 455/550.1 |
| 2004/0212535 | A1 * | 10/2004 | Tang et al. | 343/700 MS |

* cited by examiner

*Primary Examiner*—Hoanganh Le

(57) ABSTRACT

The present invention provides a mobile phone antenna, which comprises an antenna ground plane, a radiating conducting plate, a feeding conducting strip, a shorting conducting strip, and a system ground plane. Using the antenna ground plane as a shielding metal wall, the present invention advantages itself of making the antenna and a shielding metal box easier to be integrated without a need for an isolation distance. The present invention thus makes the best use of the internal spacing of a mobile phone. This antenna is suitable for application as an embedded antenna for both folded-type and bar-type mobile phones. The operating bandwidth of this antenna can cover the required bandwidth for a Universal Mobile Telecommunication System operation.

13 Claims, 12 Drawing Sheets

MOBILE PHONE ANTENNA

FIELD OF THE INVENTION

The present invention generally relates to an antenna, and more specifically to a mobile phone antenna.

BACKGROUND OF THE INVENTION

Following the global blooming in mobile communications, various kinds of handheld communication products have been demanded by wireless users. One of the major demands is to minimize the product dimensions. Generally speaking, the dimensions of a communication product can be effectively minimized by using an embedded antenna inside the communication product. However, in the existing communication products, especially those with an embedded antenna, the internal spacing for antenna is usually very limited. Thus, with this spacing limitation, how to achieve good antenna performances and good electromagnetic compatibility with nearby electronic components inside the product has become one of the major design challenges for the final communication product.

For conventional planar inverted-F antennas (PIFAs) applied to mobile phone antennas, the antenna's radiating metal plate is usually horizontally installed above the top portion of the ground plane. A feeding metal pin and a shorting metal pin are electrically connected to and perpendicular to both the radiating metal plate and the ground plane.

A ROC patent publication No. 519780, "Dual-Band and Multi-Band Planar Inverted-F Antenna and the Radiating Metal Plate," disclosed a planar inverted-F mobile phone antenna This mobile phone antenna comprises one radiating metal plate, one metal ground plane, and one feeding metal line and one shorting metal pin, which are installed perpendicularly to the radiating metal plate and the ground plane. By meandering the resonant path of the radiating metal plate to achieve dual-band operation, the size of the antenna profile can thus be minimized. The drawback of this conventional antenna design, however, is that the antenna is not easy to be integrated with other circuitry systems and associated components. This conventional antenna also requires an isolation distance from the shielding metal box of the radio frequency (RF) circuitry and RF components to reduce the destructive coupling effects on the antenna performances.

FIG. 1A shows a schematic view of a conventional mobile phone antenna with a shielding metal box 15. The antenna element for this mobile phone antenna is a conventional planar inverted-F antenna and mainly comprises one metal plate 11, one feeding metal pin 12, one shoring metal pin 13, and one ground plane 14. The feeding metal pin 12 and the shorting metal pin 13 are both perpendicular to and in between the metal plate 11 and the ground plane 14. The metal plate 11 is mainly parallel to the ground plane 14. The shielding metal box 15 is affixed to and electrically connected to the ground plane 14. Referring to FIG. 1A, the shielding metal box 15 is away from the metal plate 11 with an isolation distance d.

FIG. 1B, shows the measured return loss for the mobile phone antenna in FIG. 1A. The vertical axis represents the return loss in dB; the horizontal axis represents the operating frequencies. As shown in FIG. 1B, the measured return loss for the mobile phone antenna without a shielding metal box 15 is represented by the curve 16. The corresponding operating bandwidth, determined by 2:1 Voltage Standing-Wave Ratio (VSWR) or about 9.6 dB return loss, can cover the Universal Mobile Telecommunication System (UMTS) band. The drawback of this conventional mobile phone antenna is that with a decrease in d (that is, by moving the shielding metal box 15 close to the metal plate 11), the corresponding operating bandwidth is quickly degraded and thus can not cover the required UMTS band.

Referring to FIG. 1B, curve 161 represents the measured antenna return loss when the isolation distance d is 21 mm, while curve 162 represents the measured antenna return loss when the isolation distance d is reduced to 7 mm. To cover the UMTS band, the isolation distance d between the shielding metal box 15 and the metal plate 11 is usually required to be greater than 7 mm such that the antenna performances will not be degraded due to the coupling effects between the antenna and the shielding metal box 15. With this design configuration, the internal spacing utilization and design flexibility have become limited for this type of conventional mobile phone antenna

SUMMARY OF THE INVENTION

To overcome the drawback of the conventional mobile phone antenna, the present invention provides an improved mobile phone antenna. The mobile phone antenna according to the present invention comprises one antenna ground plane, one radiating conducting plate, one feeding conducting strip, one shorting conducting strip, and one system ground plane.

The antenna ground plane of the present invention has a first long side and a second long side. The radiating conducting plate, installed perpendicularly to the antenna ground plane, includes one feeding point and one shorting point. The feeding conducting strip, installed between the antenna ground plane and the radiating conducting plate, has two ends, which is electrically connected to the feeding point of the radiating conducting plate and the feeding signal source, respectively, so that the feeding signal can be fed into the radiating conducting plate. The shorting conducting strip, installed between the antenna ground plane and the radiating conducting plate, also has two ends, which is electrically connected to the shorting point on the radiating conducting plate and the antenna ground plane, respectively. Finally, the system ground plane is connected to the second long side of the antenna ground plane.

According to the present invention, the radiating conducting plate, the feeding conducting strip, and the shorting conducting strip can all be fabricated by using a single piece of metal sheet and be formed into a single metal plate. The metal plate is parallel to the system ground plane of the mobile phone. Alternatively, all these three elements can be printed on one dielectric substrate.

The system ground plane, according to the present invention, further comprises the first sub-ground plane and the second sub-ground plane. The first sub-ground plane includes a first short side and a second short side. In the first embodiment of the present invention, the radiating conducting plate is installed adjacent to the first short side of the first sub-ground plane. In the second embodiment of the present invention, the radiation conducting plate is installed adjacent to the second short side of the first sub-ground plane. Other than this, the rest of the configuration of the second embodiment is identical to that of the first embodiment. The mobile phone antenna according to the present invention can be applied to either folded-type mobile phones or bar-type mobile phones. In the third embodiment of the present invention, the system ground plane does not include a second sub-ground plane. Other than this, the rest of the configuration of the third embodiment is identical to that of the first embodiment.

The mobile phone antenna according to the present invention mainly utilizes the antenna ground plane as a metal shielding wall to accomplish a seamless integration between the antenna and the shielding metal box of the RF module and RF circuitry without the need of an isolation distance.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1A:
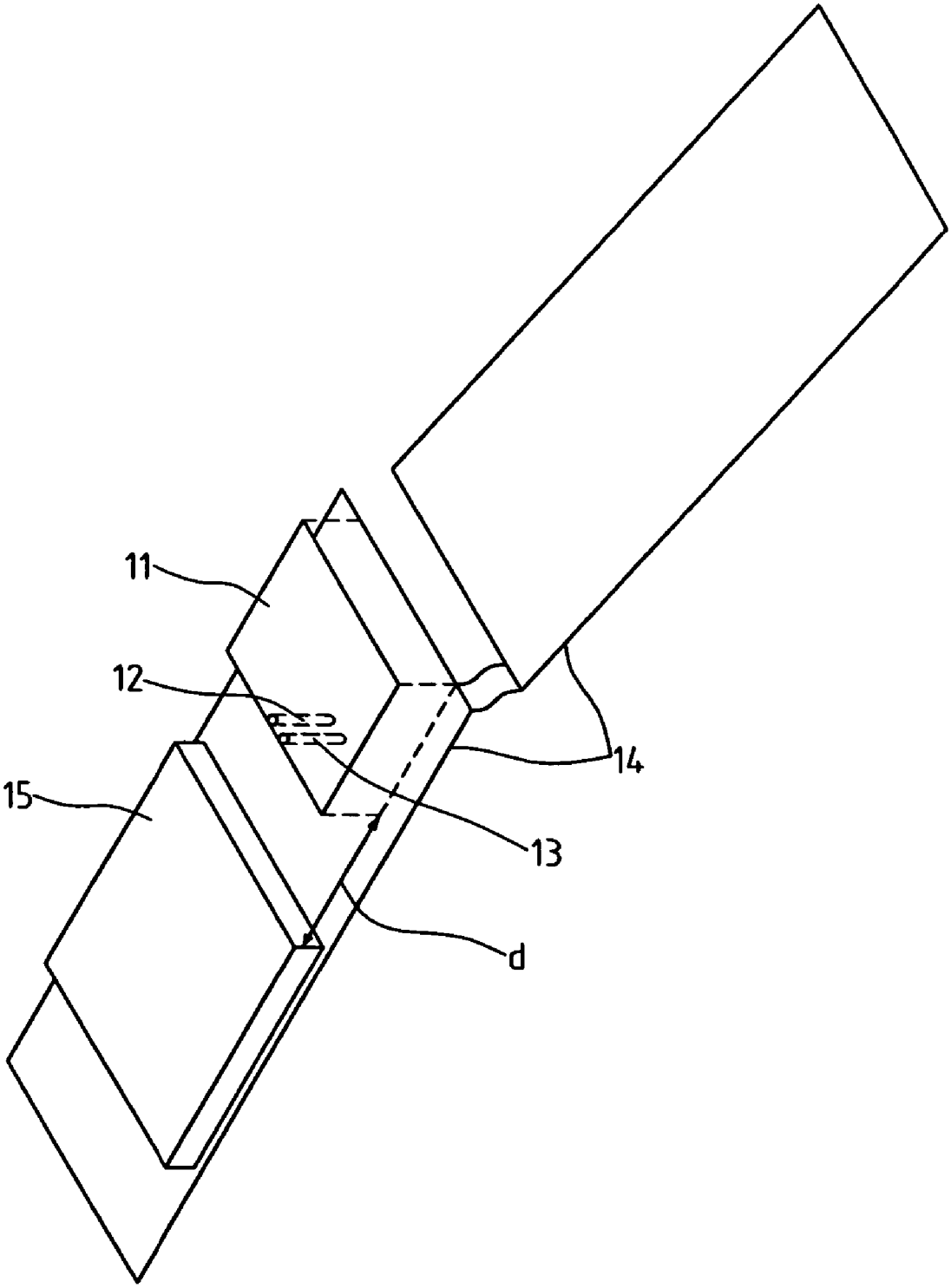
FIG. 1A (PRIOR ART)
FIG. 1A shows a schematic view of a conventional mobile phone antenna, wherein the mobile phone antenna has a metal shielding box placed from a distance.
Figure 1B:
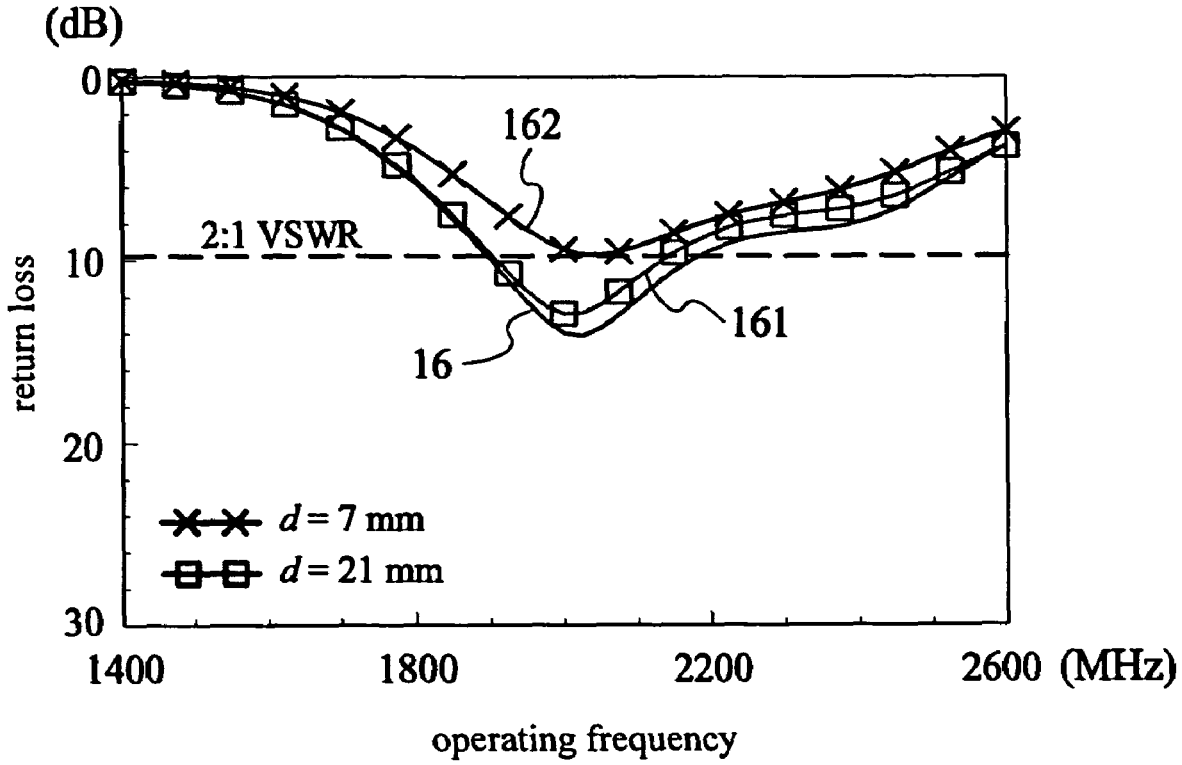
FIG. 1B shows the measured return loss for the conventional mobile phone antenna shown in FIG. 1A.
Figure 2A:
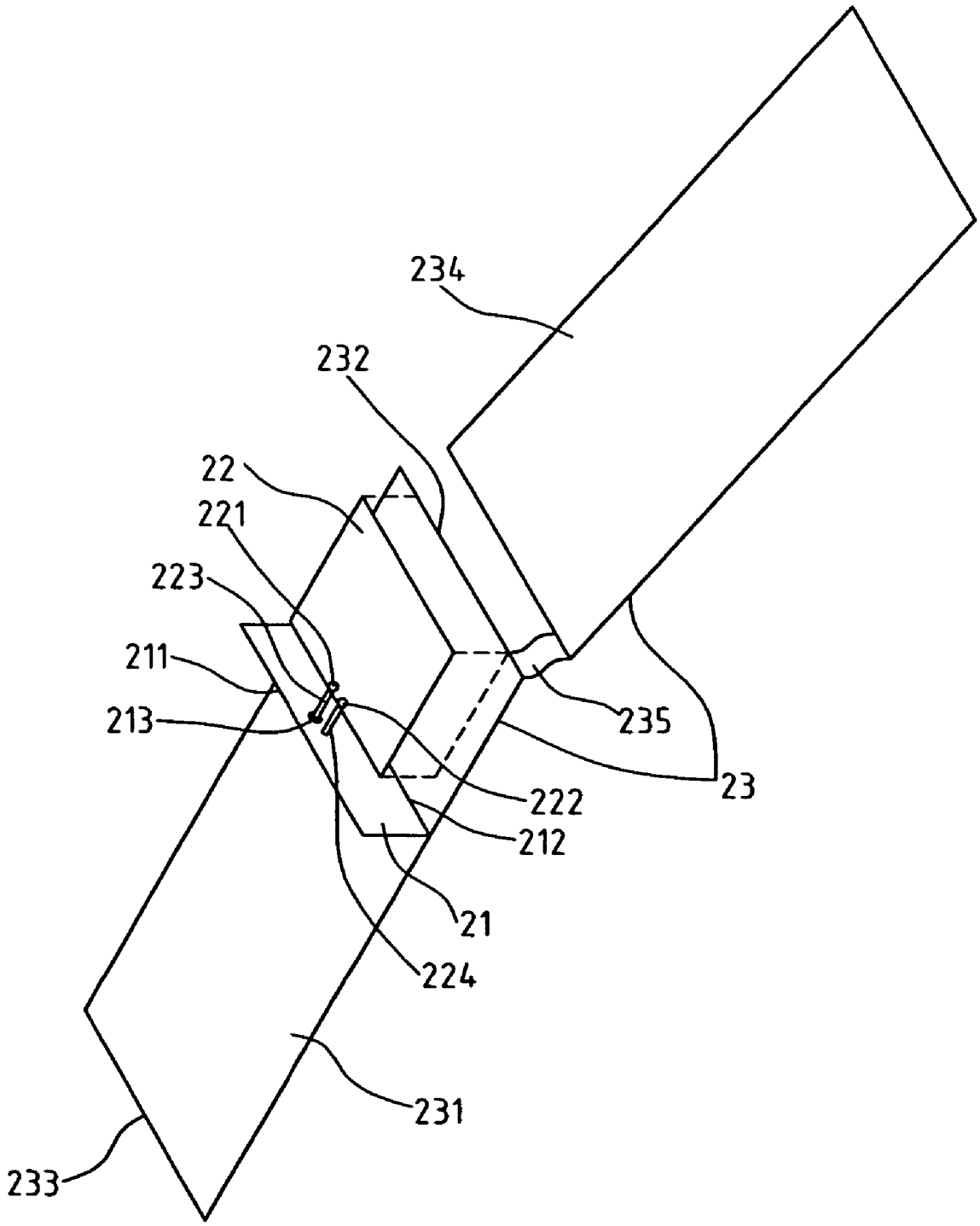
FIG. 2A shows a schematic view of a first embodiment of the present invention.

FIG. 2A illustrates a schematic view of a first embodiment of the present invention. Referring to FIG. 2A, the mobile phone antenna comprises one antenna ground plane 21, one radiating conducting plate 22, one feeding conducting strip 223, one shorting conducting strip 224, and one system ground plane 23. The antenna ground plane 21 includes one first long side 211 and one second long side 212. The radiating conducting plate 22 is installed perpendicularly to the top of the antenna ground plane 21. The radiating conducting plate 22 includes one feeding point 221 and one shoring point 222. The feeding conducting strip 223 is installed between the antenna ground plane 21 and the radiating conducting plate 22. The feeding conducting strip has two ends, which is electrically connected to the feeding point 221 on the radiating conducting plate 22 and to a feeding signal source, respectively, so that the feeding signal can be fed into the radiating conducting plate 22. The shorting conducting strip 224, installed between the antenna ground plane 21 and the radiating conducting plate 22, has two ends, which is connected to the shorting point 222 on the radiating conducting plate 22 and the antenna ground plane 21, respectively. The system ground plane 23 is connected to the second long side 212 of the antenna ground plane 21.

Through a via hole 213 on the antenna ground plane 21, the feeding conducting strip 223 feeds the feeding signal into the radiating conducting plate 22. The system ground plane 23 further includes a first sub-ground plane 231 and a second sub-ground plane 234. The first sub-ground plane 231 has a first short side 232 and a second short side 233, which are perpendicularly connected to the antenna ground plane 21 at the second long side 212 of the antenna ground plane 21. The first sub-ground plane 231 is parallel to the radiating conducting plate 22. The radiating conducting plate 22 is installed adjacent to the first short side 232 of the first sub-ground plane 231. The first sub-ground plane 231 and the second sub-ground plane 234 can be connected with a flexible printed circuit board 235.

Figure 2B:
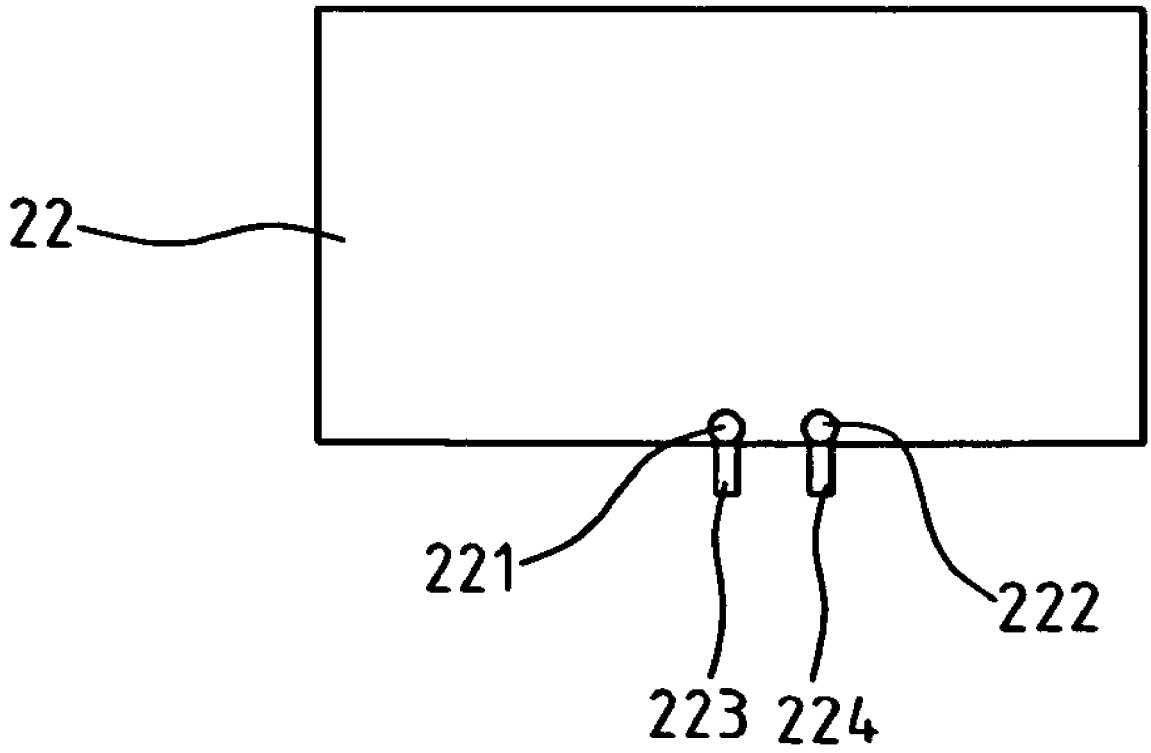
FIG. 2B shows how the radiating conducting plate, the feeding conducting strip, and the shorting conducting strip are formed into a single piece of metal plate, according to the first embodiment shown in FIG. 2A.

According to the present invention, the radiating conducting plate 22, the feeding conducting strip 223, and the shorting conducting strip 224 may be made of material like metal. As shown in FIG. 2B, these three elements may also be fabricated by cutting a single piece of conducting plate like a single piece of metal sheet. This single piece of metal plate is parallel to the system ground plane 23 of the mobile phone antenna. Alternatively, the radiating conducting plate 22, the feeding conducting strip 223, and the shorting conducting strip 224 may be formed on a dielectric substrate with the standard printing or etching fabrication process.

According to the present invention, the center operating frequency of the mobile phone antenna can be determined by adjusting the size of the radiating conducting plate 22. A good impedance matching for the antenna can be achieved by properly selecting the size of the distance between the radiating conducting plate 22 and the system ground plane 23, as well as the proper selection of the shorting position for the shorting conducting strip 224.

Figure 3:
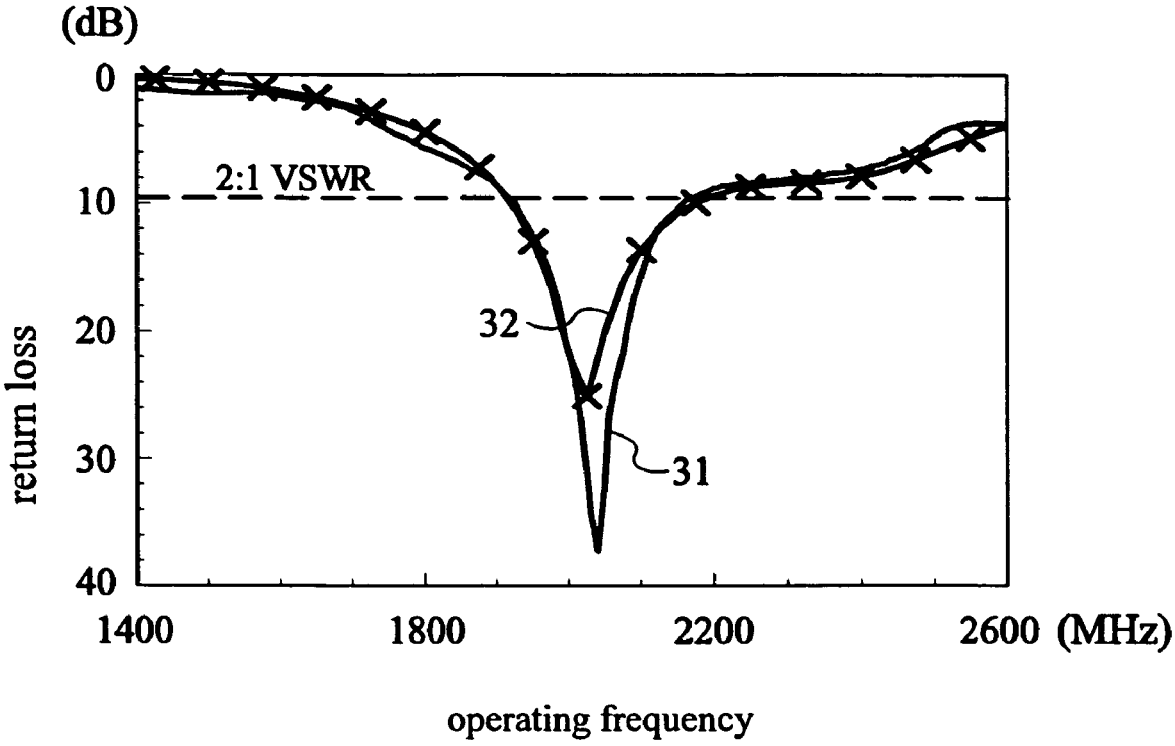
FIG. 3 shows the measured and simulated return loss for the first embodiment of the present invention.

FIG. 3 illustrates the measured return loss for the first embodiment of the present invention. Wherein, the vertical axis represents the return loss in dB, while the horizontal axis represents the antenna operating frequencies in MHz. The following are the dimensions used for the experimental mobile phone antenna design. The antenna ground plane 21 is 40 mm in length and 8 mm in width. The radiating conducting plate 22 is of a rectangle with 30 mm in length and 18 mm in width. The feeding conducting strip 223 and the shorting conducting strip 224 have the same length of 2 mm, but have different width of 1 mm and 0.5 mm, respectively. For the system ground plane 23, the first sub-ground plane 231 and the second sub-ground plane 234 both have the same dimension of 70 mm in length and 40 mm in width. The inclined angle between the first sub-ground plan 231 and the second sub-ground plane 234 is approximately 165°.

Referring to FIG. 3, the curve 31 from the measured results shows agreement with the curve 32 from the simulation. Determined by 2:1 VSWR, the antenna operating bandwidth can well cover the required for the UMTS band.

Figure 4:
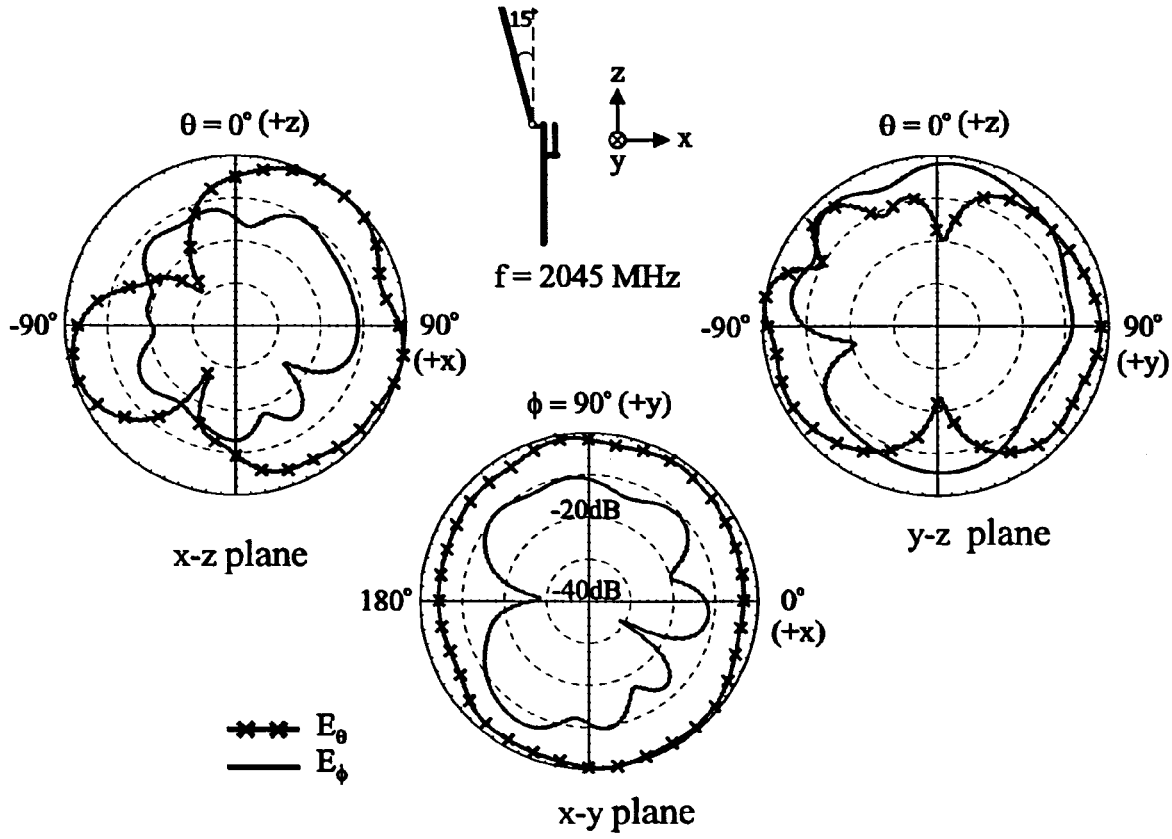
FIG. 4 shows the measured antenna radiation pattern when the first embodiment of the present invention operates at 2045 MHz.

FIG. 4 illustrates the measured results of the antenna radiation patterns, in the planes x-z, y-z, and x-y, respectively, when the first embodiment of the present invention operates at 2045 MHz. The results demonstrate a good omnidirectional radiation pattern in the x-y plane.

Figure 5:
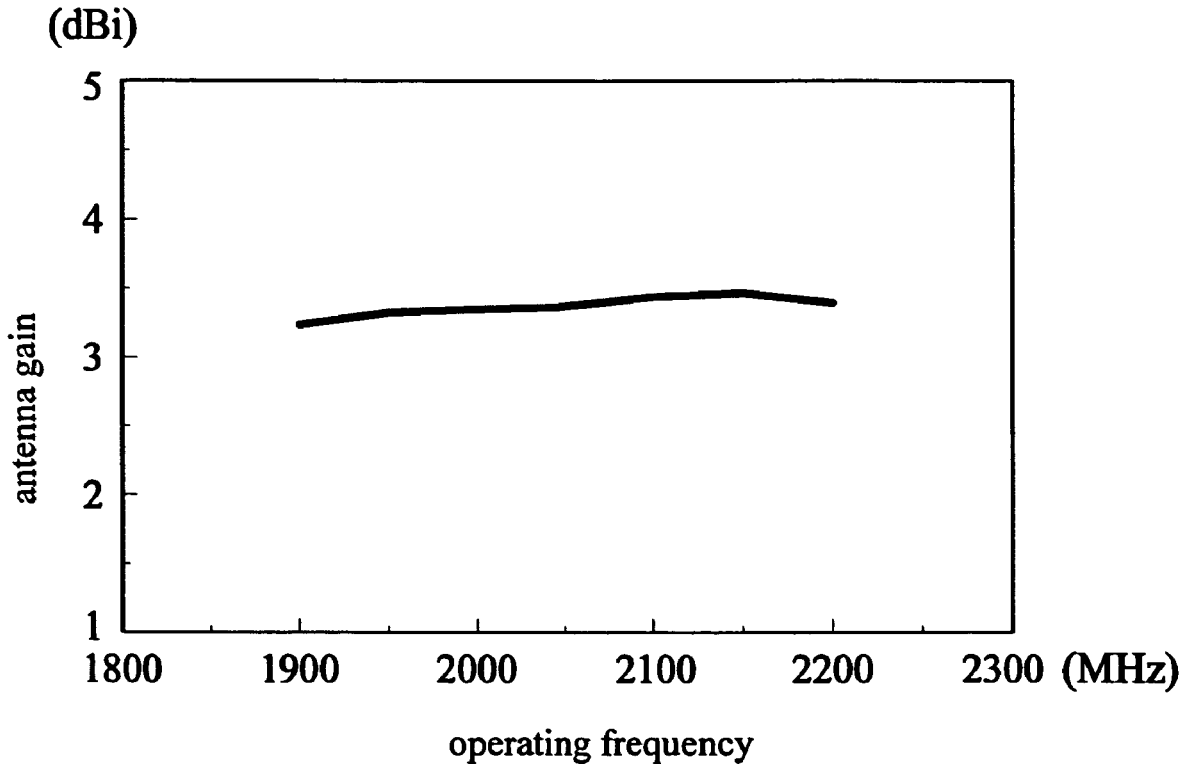
FIG. 5 shows the measured antenna gain for the first embodiment of the present invention.

FIG. 5 shows the measured results of the antenna gain for the first embodiment of the present invention, wherein the vertical axis represents the antenna gain, while the horizontal axis represents the antenna operating frequencies. According to FIG. 5, the antenna gain level is about 3.4 dBi within the operating frequencies, which meets the antenna gain requirement for the UMTS operation.

Figure 6:
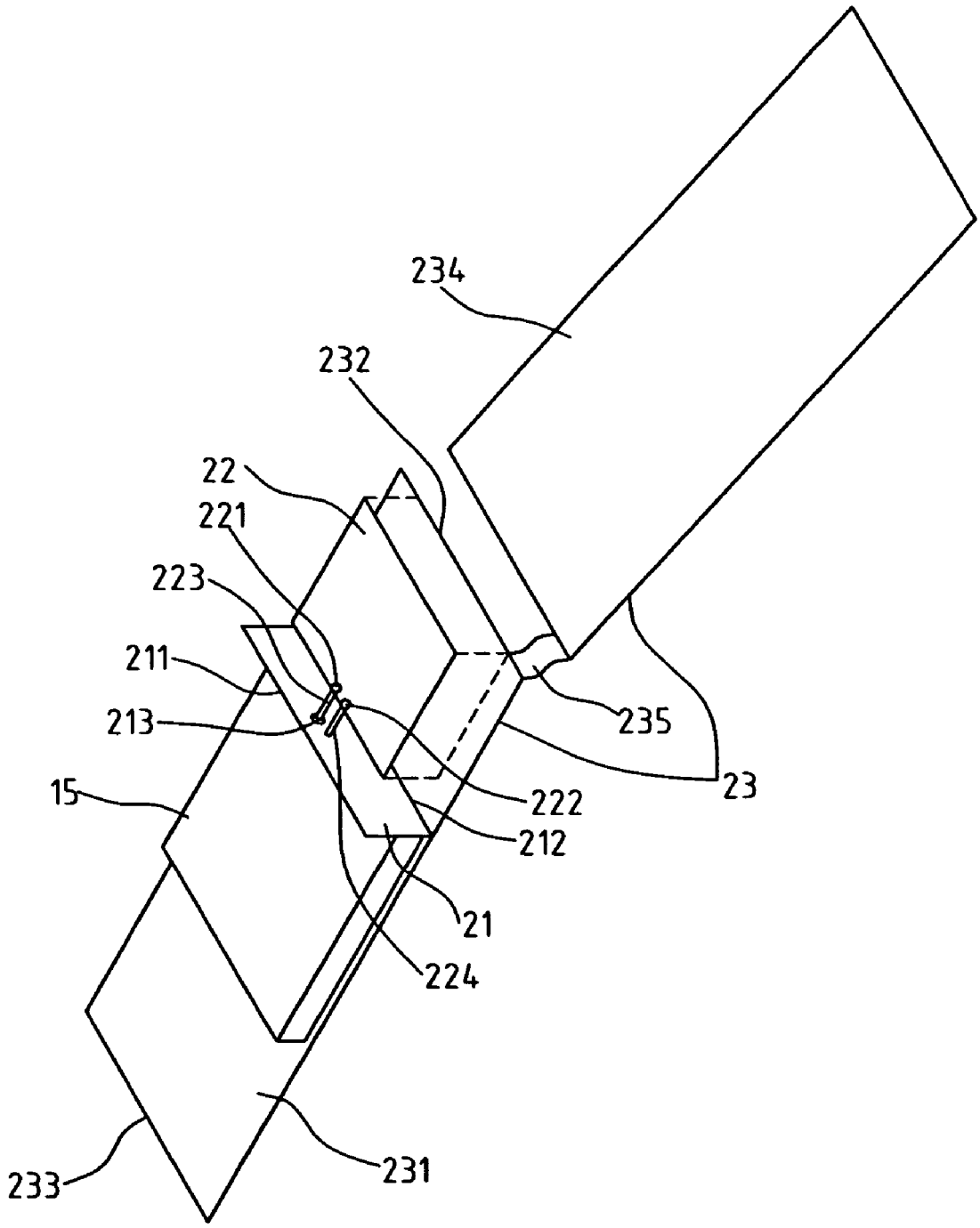
FIG. 6 shows a perspective view of a variation of the first embodiment of the present invention by adding a RF shielding metal box.

FIG. 6 shows a perspective view of a variation of the first embodiment of the present invention by adding a RF shielding metal box. Referring to FIG. 6, the shielding metal box 15 is affixed to and electrically connected to the first sub-ground plane 231 of the system ground plane 23. The shielding metal box 15 is also very close to the antenna ground plane 21 and the radiating conducting plate 22. The isolation distance d between the radiating conducting plate 22 and the shielding metal box 15 may be eliminated. In this case, the dimension of the shielding metal box 15 is 40 mm in length, 30 mm in width, and 5 mm in height.

Figure 7:
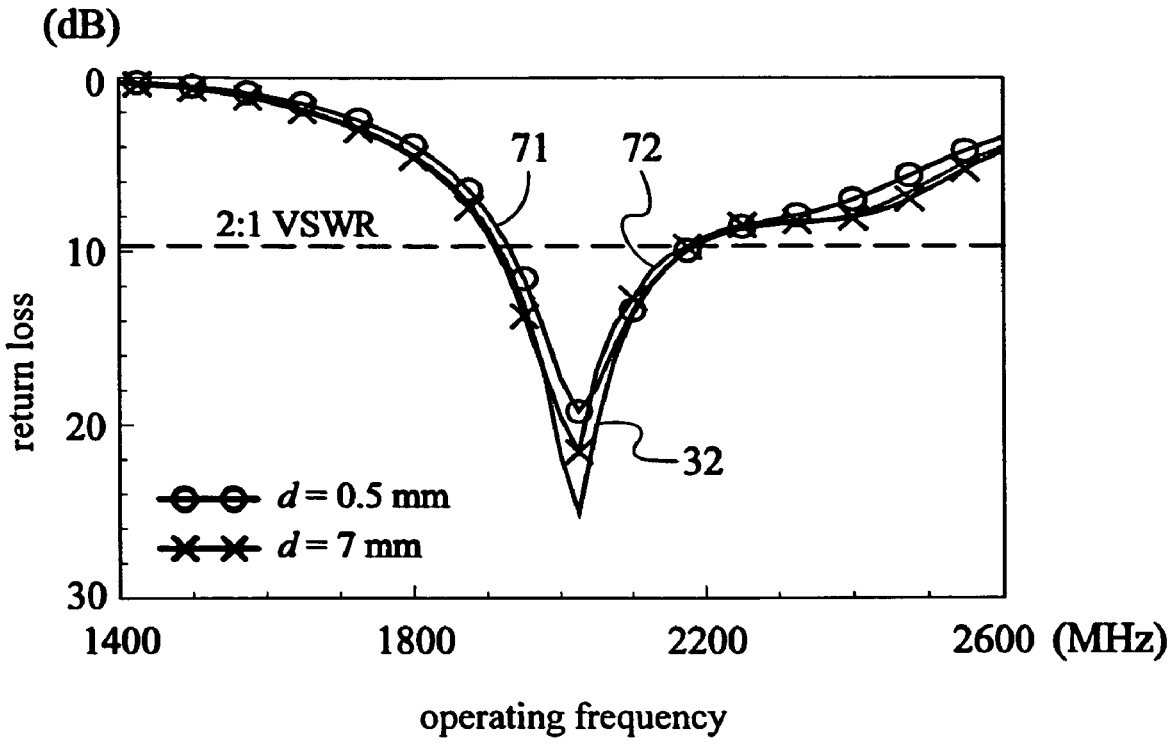
FIG. 7 shows the measured return loss for the variation of the first embodiment as shown in FIG. 6.

FIG. 7 shows measured return loss for the variation of the first embodiment as shown in FIG. 6. Referring to FIG. 7, the curve 71 for the measured return loss with the isolation distance d of 0.5 mm and the curve 72 for the measured return loss with the isolation distance d of 7 mm are quite consistent with the cure 32 for the simulated return loss shown in FIG. 3.

Using the antenna ground plane 21 as a shielding metal wall, the mobile phone antenna of the present invention can minimize the destructive coupling effects even with the shielding metal box 15 placed in very close proximity to both the antenna ground plane 21 and the radiating conducting plate 22. This thus overcomes the restriction of a required isolation distance to accomplish an effective integration of the antenna and the shielding metal box 15 of the RF module and RF circuitry. Determined by 2:1 VSWR, the corresponding operating bandwidth can well cover the UMTS band.

Figure 8:
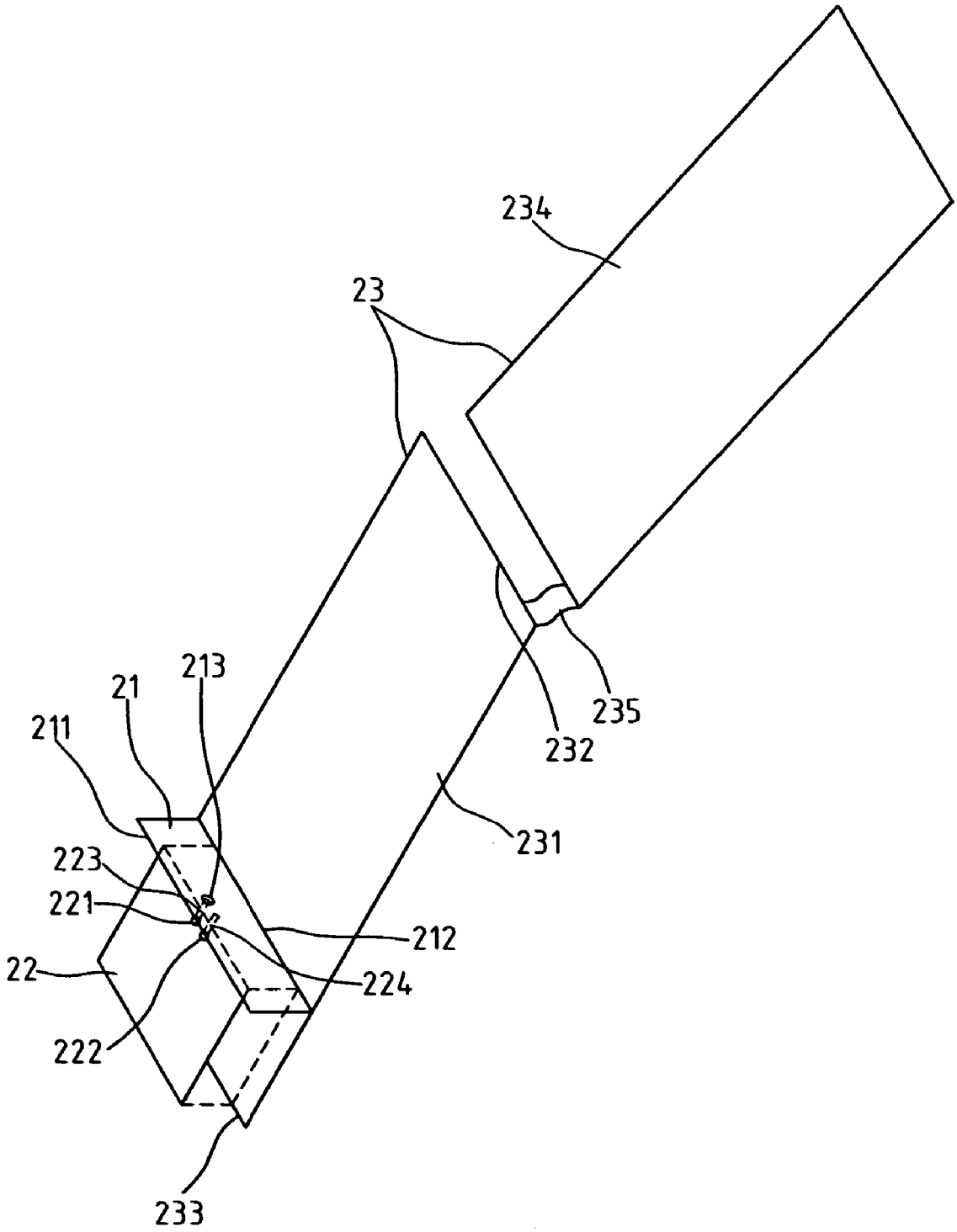
FIG. 8 shows a schematic view of a second embodiment of the present invention.

FIG. 8 shows a schematic view of the second embodiment of the present invention. Wherein, the radiating conducting plate 22 is installed adjacent to the second short side 233 of the first sub-ground plane 231. The rest of the configuration is identical to that for the first embodiment shown in FIG. 2A.

The mobile phone antenna according to the present invention may be applied to either folded-type or bar-type mobile phones.

Figure 9:
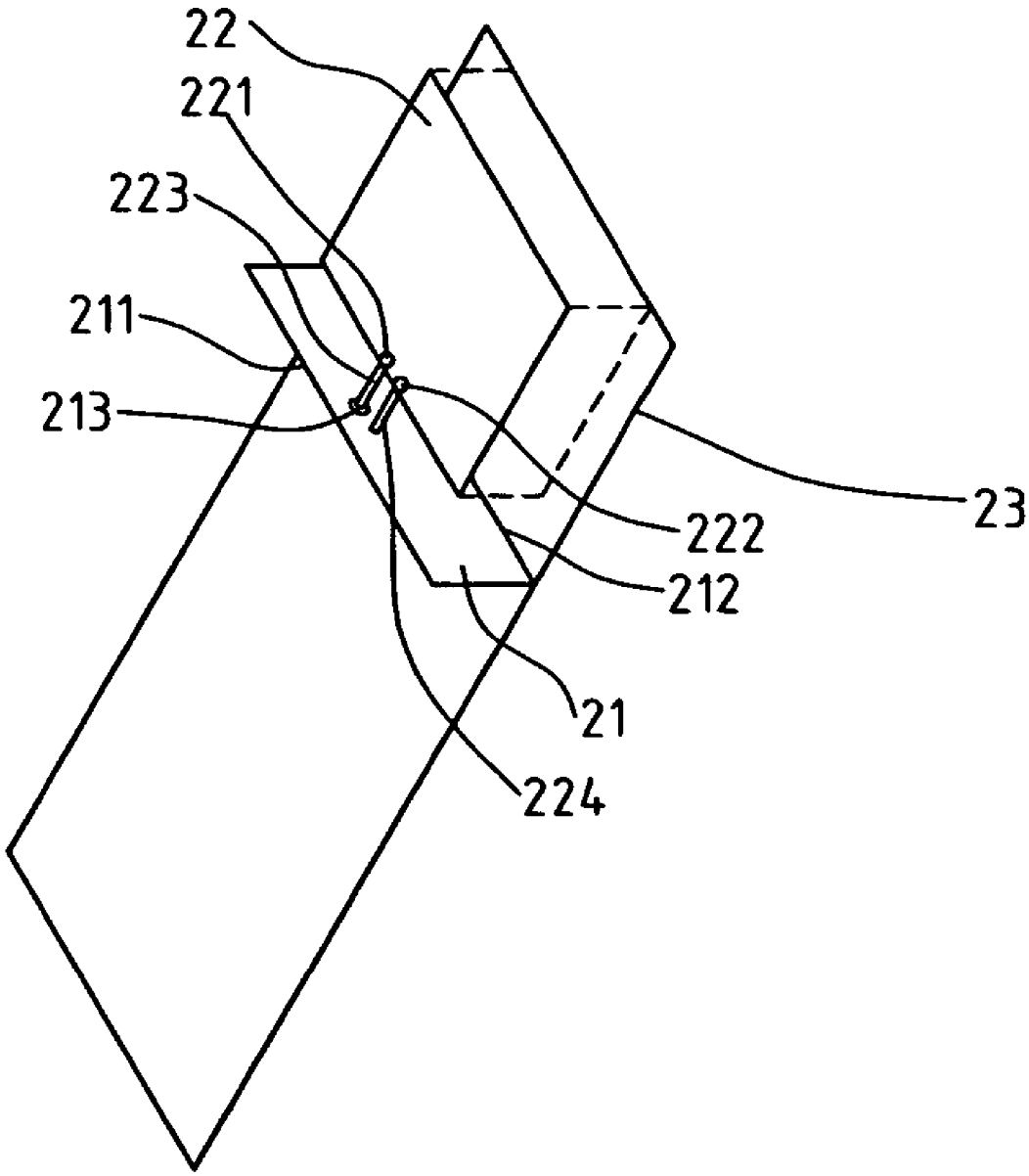
FIG. 9 shows a schematic view of a third embodiment of the present invention.

FIG. 9 shows a schematic view of the third embodiment of the present invention. Wherein, the system ground plane 23 does not include the second sub-ground plane 234. The rest of the configuration is identical to that of the first embodiment shown in FIG. 2A.

Figure 10:
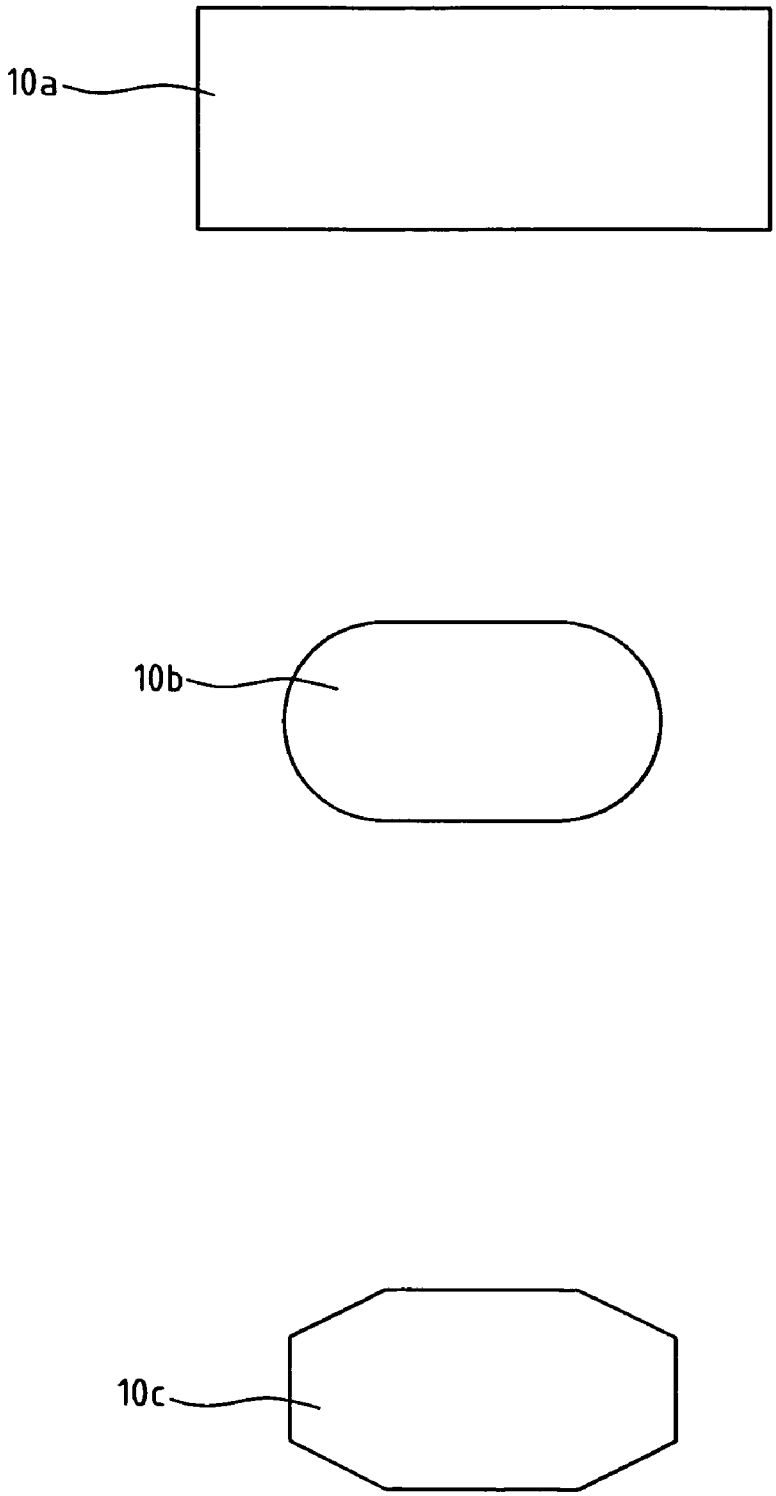
FIG. 10 shows variations in shape for the radiating conducting plate of the present invention.

FIG. 10 shows the variations in shape for the radiating conducting plate 22 according to the present invention. Examples show that the shape of the radiating conducting plate 22 can be a rectangle 10*a*, an oval 10*b*, and a polygon 10*c*.

In conclusion, the mobile phone antenna of the present convention not only eliminates the need of an isolation distance between the antenna and the shielding metal box, but also accomplishes the ease for integrating the antenna and the shielding metal box with more effective utilization of the internal spacing within a mobile phone.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A mobile phone antenna, comprising:

an antenna ground plane having a first long side and a second long side;

a radiating conducting plate installed on the top of and perpendicularly to said antenna ground plane, and on which there being one feeding point and one shorting point;

one feeding conducting strip installed between said antenna ground plane and said radiating conducting plate, having two ends electrically connected to said feeding point on said radiating conducting plate and to a feeding signal source, respectively, so that said feeding signal being fed into said radiating conducting plate;

a shorting conducting strip installed between said antenna ground plane and said radiating conducting plate, having two ends electronically connected to said shorting point on said radiating conducting plate and to said antenna ground plane; and a system ground plane connecting to said second long side of said antenna ground plane.

2. The mobile phone antenna as claimed in claim 1, wherein said antenna ground plane further includes a via hole, such that said feeding conducting strip feeds said feeding signal into said radiating conducting plate through said via hole.

3. The mobile phone antenna as claimed in claim 1, wherein said system ground plane is perpendicularly connected to said second long side of said antenna ground plane, and said system ground plane is parallel to said radiating conducting plate.

4. The mobile phone antenna as claimed in claim 1, wherein said system ground plane further comprises:

a first sub-ground plane having a first short side and a second short side; and a second sub-ground plane, said first short side of said first sub-ground plane electrically connected to said second sub-ground plane.

5. The mobile phone antenna as claimed in claim 4, wherein said radiating conducting plate is installed in adjacent to said first short side of said first sub-ground plane.

6. The mobile phone antenna as claimed in claim 4, wherein said radiating conducting plate is installed in adjacent to said second short side of said first sub-ground plane.

7. The mobile phone antenna as claimed in claim 5, wherein said first sub-ground plane is perpendicularly connected to said second long side of said antenna ground plane, and said first sub-ground plane is parallel to said radiating conducting plate.

8. The mobile phone antenna as claimed in claim 6, wherein said first sub-ground plane is perpendicularly connected to said second long side of said antenna ground plane, and said first sub-ground plane is parallel to said radiating conducting plate.

9. The mobile phone antenna as claimed in claim 1, wherein, said radiating conducting plate, said feeding conducting strip, and said shorting conducting strip are all installed on a single conducting plate.

10. The mobile phone antenna as claimed in claim 1, wherein said radiating conducting plate, said feeding conducting strip, and said shorting conducting strip are all installed on a dielectric substrate.

11. The mobile phone antenna as claimed in claim 1, wherein said radiating conducting plate is in the shape of a rectangle.

12. The mobile phone antenna as claimed in claim 1, wherein said radiating conducting plate is in the shape of an oval.

13. The mobile phone antenna as claimed in claim 1, wherein said radiating conducting plate is in the shape of a polygon.

* * * * *